United States Patent [19]

Donica

[11] Patent Number: 4,815,739

[45] Date of Patent: Mar. 28, 1989

[54] GOLF PUTTER

[76] Inventor: Claude E. Donica, 6005 S. Atlanta Ct., Tulsa, Okla. 74105

[21] Appl. No.: 125,884

[22] Filed: Nov. 27, 1987

[51] Int. Cl.[4] ..... A63B 53/02

[52] U.S. Cl. ..... 273/80 C; 273/78; 273/167 H; 273/167 R

[58] Field of Search ..... 273/80 C, 80.1–80.8, 273/167 R, 167 A–167 K, 174, 77 R, 169, 171–173, 194 R, 72 R, 72 A, 78; D21/214, 215, 217

[56] References Cited

U.S. PATENT DOCUMENTS

D. 234,960 4/1975 Swash ..... 273/167 F 3,841,640 10/1974 Gaulocher ..... 273/164 R 4,141,556 2/1979 Paulin ..... 273/164

*Primary Examiner*—Richard C. Pinkham

*Assistant Examiner*—S. Passaniti

*Attorney, Agent, or Firm*—Head & Johnson

[57] ABSTRACT

A golf putter which provides an enlarged "sweet spot" by connecting the shaft to a rearwardly extending semicircular support so as to disjoin the shaft directly from the putter's faceplate or blade. The support consists of a plurality of spoke-like members extending to an attachment locus toward, but not touching the rear face of the faceplate; thus, causing the force of a struck ball to be transmitted to the shaft.

12 Claims, 1 Drawing Sheet

Fig. 1
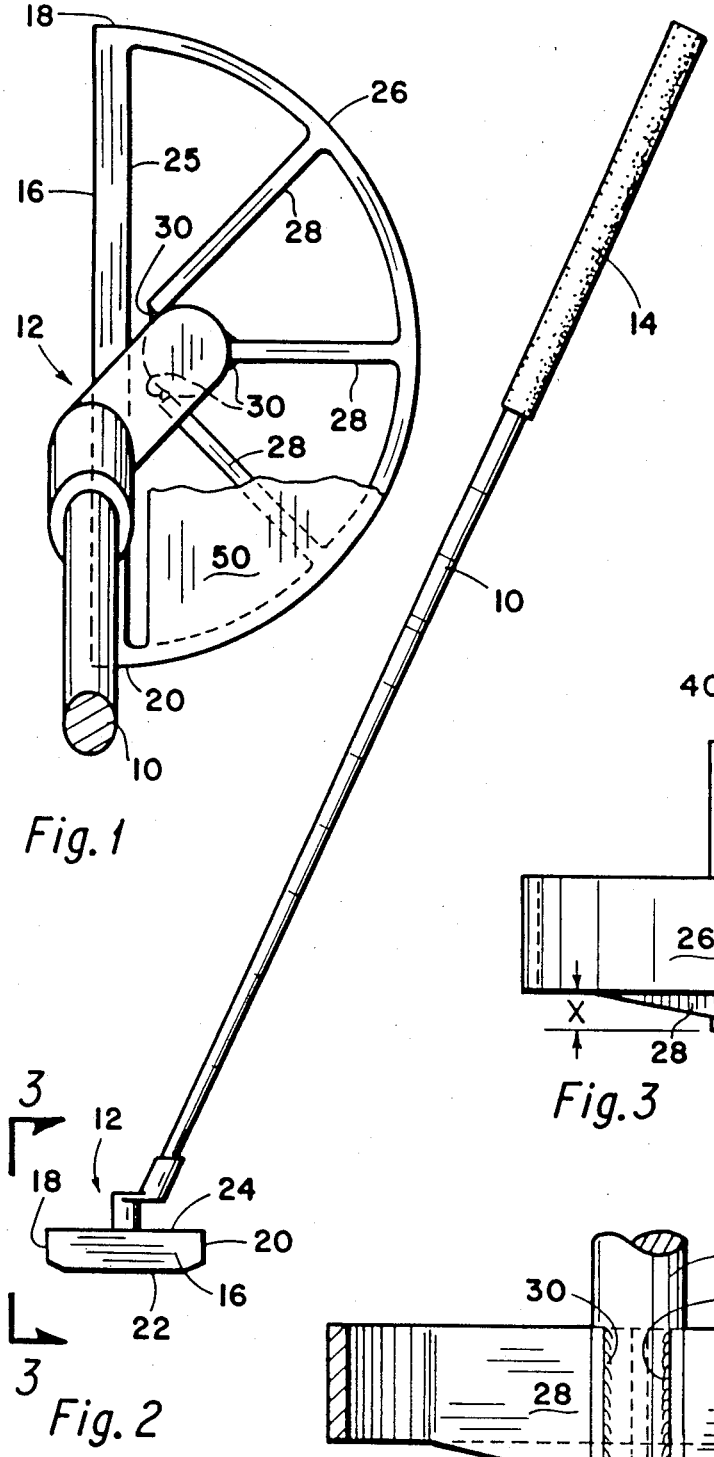
Fig. 2
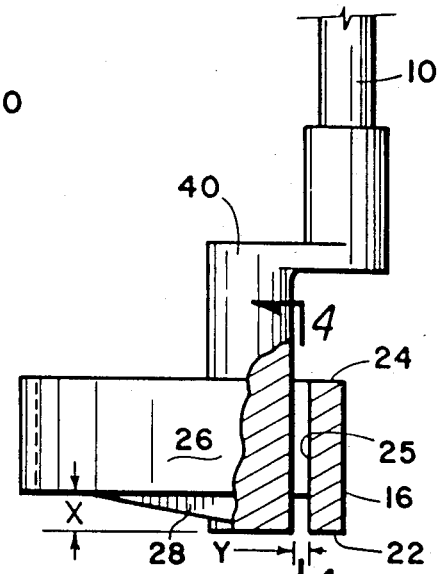
Fig. 3
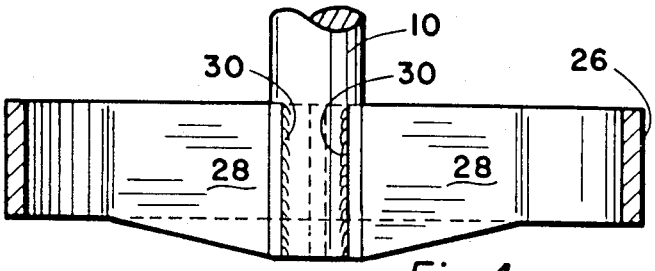
Fig. 4

GOLF PUTTER

PRIOR ART STATEMENT

The following patents are relevant to the state of the art for golf putters.

| Patent No. | Patentee |
|---|---|
| D-234,962 | Harold Edward Swash |
| 3,888,492 | Nat Cabot |
| D-235,668 | Harold Edward Swash |
| 3,921,984 | Lloyd C. Winter |
| 4,010,958 | Steven K. Long |
| 4,141,556 | Leo J. Paulin |
| 4,147,357 | William H. Strop |

The prior art represents typical golf putters wherein the patentee strives to achieve perfect alignment with the center of the putter faceplate or blade as represented by the patents of Cabot, Winter, Strop, Paulin, and Swash. The 'Long' U.S. Pat. No. 4,010,958 is representative of a concept of providing a greater weight or mass at the heel and toe and corners of the square headed club as a means to increase the effective hitting area or "sweet spot."

SUMMARY OF THE INVENTION

This invention has for its object to provide a golf putter in which the moment of inertia or "sweet spot" is substantially increased. This will provide greater latitude from the ill effects of striking the golf ball at a point on the face of the club other than the exact center.

A further object of this invention is to provide a golf putter wherein the shaft is disjoined from direct attachment to the putter faceplate or blade. The shaft is connected to the putter blade by a curved or semi-circular, spoked support that is attached only to the heel and the toe of the putter blade. Preferably, the shaft is connected to at least one or a plurality of radially extending spoke-like members at an attachment locus directly behind the blade.

Since the putter blade is connected to the supporting spoked, curved or circular support at the heel and toe which in turn is then attached to the shaft, this provides a larger effective hitting area (moment of inertia) or "sweet spot". With an off-center strike of the ball, the inertial forces are dampened by the construction of the curved rearward support and radiating spokes which transmit the forces to the shaft, after the ball is struck.

Specifically, the invention is directed to a golf club, more particularly a golf putter with a club head having a blade for striking a golf ball. The blade is defined by a toe and a heel, a front and rear face and a top and bottom sole. A curved support means extends rearwardly of the faceplate from its connection at the toe to the heel. At least one spoke-like member extends from the curved support, usually radially inward to an attachment locus that is directed toward but not touching the rear face of the blade. A club shaft constituting at its top end a handle for the golf club is connected at its bottom end to the attachment locus.

BRIEF DESCRIPTION OF THE DRAWINGS

FIG. 1 is a top elevational view of the club head.

FIG. 2 is a front elevational view of the entire golf putter.

FIG. 3 is an elevational view taken along the line 3—3 of FIG. 2.

FIG. 4 is a sectional view taken along line 4—4 of FIG. 3.

DETAILED DESCRIPTION OF THE DRAWINGS

Before explaining the present invention in detail, it is to be understood that the invention is not limited to its application to the details of construction and arrangement of parts illustrated in the accompanying drawings, since the invention is capable of other embodiments and of being practiced or carried out in various ways commensurate with the claims herein. Also it is to be understood that the phraseology or terminology employed herein is for the purpose of description and not of limitation.

Referring now to FIG. 1 a golf club embodying the present invention comprises a shaft 10 and a club head generally designated by the numeral 12 at the lower end of the shaft while a handle or grip portion 14 is provided at the golfer's end of the shaft. The club head comprises a blade or faceplate 16 which is the portion of the club head intended to contact the golf ball. The blade is elongated in the horizontal direction perpendicular to the putting alignment or strike line of the golfer. The blade comprises a toe 18 and a heel 20 with a bottom plate or sole 22 and a top portion 24. The thickness of the blade is such as to not produce a bounce or a spring effect, i.e., without any substantial resiliency, which can be determined by appropriate tests. Typically, the thickness is at least about one-quarter inch. Extending in a rearward direction is a curved support means 26 which extends from the toe 18 to the heel 20 and may be of any circular configuration. In this instance, the design is shown as being semi-circular of a diameter equal to the toe to heel length of the blade. Preferably, the curved support means extends slightly above the bottom face 22 of the faceplate, a distance "X" (see FIG. 3). At least one spoke-like member or members 28 extend from the curved support beams toward or radially, but not touching the rear face 25 of the faceplate 16, to a common attachment locus 30 for the bottom end of the shaft 10. In the embodiment shown the bottom edge of the spokes 28 angle downwardly from the curved support to the bottom of the extended shaft. The position of the locus 30 being such that there is a space "Y" between the shaft and/or the attachment locus and the rear surface of the putter blade 25. By disjoining the shaft directly from the blade the spoked curved blade support provides maximum heel-toe thrust no matter where the blade strikes the ball. In the embodiment shown, the shaft is connected to the club head 12 at the attachment locus by a "goose-neck" or offset arrangement 40. In this particular embodiment, the longitudinal axis of the club shaft 10 is in alignment with the front face 16 of the blade. It is to be understood however that other means of connecting the shaft to the attachment locus are within the scope and coverage of this invention. For example, the shaft could be attached wherein the longitudinal axis of the shaft 10 is in alignment with the axis of the attachment locus.

The putter head can be either machine fabricated or cast from a variety of metals or alloys, to provide a variety of weights and densities to the overall configuration. Also the putterhead can be covered by a plate 50 atop and/or below the curved support means, as shown partially in FIG. 1.

What is claimed:

1. A golf club comprising a club head having a blade for striking a golf ball, said blade defining a toe and heel, a front face and rear face, a top and bottom sole;

a curved support means extending rearwardly of said blade from the toe to the heel, at least one spoke-like member from said curved support means extending to an attachment locus toward but not touching the rear face of said blade;

a club shaft constituting at a top end a handle for said golf club with a bottom end of said shaft connected to said spoke-like member at said attachment locus.

2. The golf club of claim 1 wherein said curved support member is semicircular.

3. The golf club of claim 1 wherein there are a plurality of said spoke-like members which extend radially inwardly to said attachment locus.

4. The golf club of claim 1 wherein a longitudinal axis of said club shaft is in an off-set connection to said attachment locus.

5. The golf club of claim 4 wherein said axis of said club shaft is substantially aligned to intersect said club head.

6. The golf club of claim 4 wherein said axis of said club shaft is aligned with said front face of said blade.

7. The golf club of claim 1 wherein a bottom edge of said curved support means extends vertically above a plane defined by said bottom sole.

8. The golf club of claim 7 wherein the bottom of each of said spoke-like members angles downwardly from said support means to a locus at or above said plane defined by said bottom sole.

9. The golf club of claim 1 wherein the junction of said bottom sole with said toe and heel are beveled.

10. The golf club of claim 1 wherein a top of said curved support means is covered.

11. The golf club of claim 1 wherein a bottom of said curved support means is covered 12. The golf club of claim 1 wherein a top and a bottom of said curved support means is covered.

* * * * *